United States Patent [19]

Ruhl et al.

[11] 4,231,718

[45] Nov. 4, 1980

[54] FLUID PUMP, PARTICULARLY A FUEL SUPPLY PUMP

[75] Inventors: Karl Ruhl, Gerlingen; Ulrich Kemmner, Sachsenheim, both of Fed. Rep. of Germany

[73] Assignee: Robert Bosch GmbH, Stuttgart, Fed. Rep. of Germany

[21] Appl. No.: 932,389

[22] Filed: Aug. 9, 1978

[30] Foreign Application Priority Data

Sep. 15, 1977 [DE] Fed. Rep. of Germany ..... 2741535

[51] Int. Cl.[3] ..... F04B 39/06; F04B 17/00

[52] U.S. Cl. ..... 417/366; 415/53 T

[58] Field of Search ..... 417/423 R, 366; 415/53 T, 213 T

[56] References Cited

U.S. PATENT DOCUMENTS

| | | | |
|---|---|---|---|
| 3,507,582 | 4/1970 | Jeep et al. | 417/366 |
| 3,666,381 | 5/1972 | Ulm et al. | 417/423 R |
| 3,871,797 | 3/1975 | Igarashi | 417/423 R |
| 3,873,243 | 3/1975 | Nusser et al. | 417/423 R |

FOREIGN PATENT DOCUMENTS

| | | | |
|---|---|---|---|
| 2538689 | 3/1977 | Fed. Rep. of Germany | 417/366 |
| 1382731 | 2/1975 | United Kingdom | 417/423 R |

*Primary Examiner*—Richard E. Gluck

*Attorney, Agent, or Firm*—Edwin E. Greigg

[57] ABSTRACT

An electric motor-driven fluid pump, more particularly a fuel supply pump, simply and cost effectively constructed from only a few individual parts, preferably molded of a synthetic material, and preassembled as structural groups. The preferred embodiment comprises a pump of the lateral channel type having an impeller made integral with the motor armature; a tubular central housing portion which encloses the permanent magnets of the electric motor; and flange-like housing terminals on both sides of the central housing portion. The exteriors of the housing terminals are provided with pressure and suction nozzles and the interiors are provided with the stationary part of the pump and the commutator guides for the collector.

12 Claims, 6 Drawing Figures

FLUID PUMP, PARTICULARLY A FUEL SUPPLY PUMP

BACKGROUND OF THE INVENTION

This invention relates to a fluid pump and in particular to a fuel supply pump for supplying fuel to the internal combustion engine of a motor vehicle.

In known fuel supply pumps in which the fluid pump itself is located in a common housing with the driving electric motor, there are many individual structural elements and parts which must be assembled and mounted with painstaking care for proper alignment and relationship with each other. Thus, the known fuel supply pumps are relatively expensive and there is a need for a fluid pump, especially a fuel supply pump which is structurally simple, of the smallest possible dimension and which can be utilized either inside or outside the fuel tank and which can deliver a reliable supply of fuel at a suitable pressure to internal combustion engines having either carburetors or injection systems.

OBJECTS AND SUMMARY OF THE INVENTION

Accordingly, it is a primary object of this invention to provide a fluid pump with its pump and driving motor arranged advantageously in a common housing of a simple structure with only a few individual parts, which can be preassembled, facilitating trouble-free assembly and which is highly effective and completely reliable.

This object and other objects, which will become apparent from a consideration of the following description of the preferred embodiment are accomplished by using molded synthetic parts which do not require subsequent machining as a cost effective measure. Another object of the invention is to provide a fluid pump which will operate under extreme vapor and liquid fuel supply relationships since the pump is provided with an excellent means for ventilation thus making installation in a fuel tank feasible; however, installation outside the tank is possible without a great amount of additional expense. Ease of installation within the tank is also advantageously accomplished because of the small structural size of the pump.

Particularly advantageous are the protection of the parts against corrosion and the frictional characteristic of the sliding parts resulting from the extensive employment of synthetic material, and the invention also provides for continuous adjustment of any axial play between the housing terminals of the pump and the pump rotor such that the longer the running time and the more the wear, the axial play becomes smaller thus improving the pump effectiveness.

The invention is further advantageously arranged so that the supply of current from the terminal bolts takes place via commutator brushes held in place in the other terminal of the housing. Thus, the current flows through the brush springs which provide the commutator brushes with a definitive voltage. This is particularly advantageous in the in-tank installation where leakage of the delivered fuel flowing past the terminal bolts cool the brush springs.

The invention will be better understood as well as further objects and advantages thereof become more apparent from the following detailed description of the preferred embodiment taken in conjunction with the drawings.

BRIEF DESCRIPTION OF THE DRAWINGS

FIGS. 2*a* and 2*b* show the first housing part of the pump as a terminal flange on the suction side of the pump with FIG. 2*a* showing the side having the suction nozzle while FIG. 2*b* is the view of the side facing the pump rotor.

DESCRIPTION OF THE PREFERRED EMBODIMENT

Figure 1A:
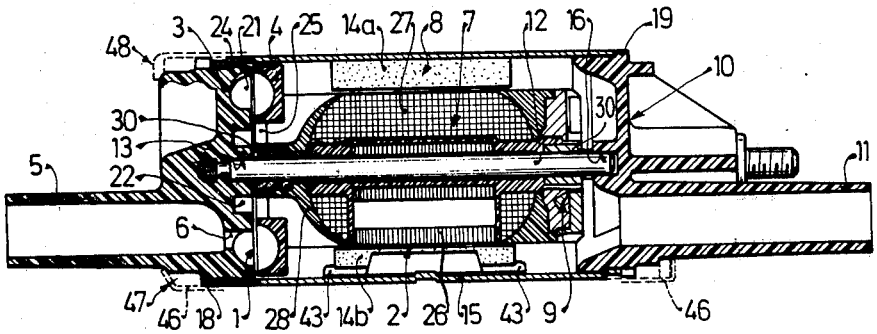
FIG. 1*a* is a vertical sectional view of the fuel supply pump constructed in accordance with the teachings of this invention.

First, the basic structure and the fundamental operating principle of a pump having an electric motor arranged in a common housing will be generally described, however, it is to be noted at the outset that, in the case of the pump of FIG. 1*a*, the housing is not a separate structural part but rather is formed by the exterior areas of the structural elements which perform additional tasks either in connection with supplying the fuel or driving the pump besides the task of forming the pump housing.

In general, the fuel supply pump of FIG. 1*a* comprises a pumping stage 1 which is attached to an electric motor 2 shown located to the right of the pumping stage in the drawing. The pumping stage 1 comprises a base plate or front flange-like terminal housing part 3 and a pump rotor 4 and, in the illustrated embodiment, is a lateral channel type pump. A suction nozzle 5 is made integral with the base plate 3 to which may be attached a fuel hose (not shown) or the nozzle may open directly into the fluid in a tank in an in-tank installation. Suction nozzle 5 opens into a suction opening 6 of the lateral channel pump.

The impeller 4 is driven by the electric motor 2 which comprises a rotating motor armature 7 as well as the magnetic components 8. On the side opposite the pumping stage 1, the collector area of the electric motor is located to which is connected a second flange-like housing part called a terminal housing 10. A pressure nozzle is formed on the terminal housing, preferably one piece therewith.

According to the preferred embodiment of the invention, the fuel supply pump described above, comprises four main structural groups which are partially preassembled.

Figure 2A:
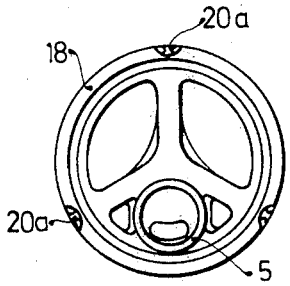

The first structural group comprises the base plate 3 forming a first flange-like terminal housing part of the lateral channel pump, which is a one piece synthetic material extrusion molded, structured on the impeller side to form part of the pump and also formed with the suction nozzle 5. This base plate 3 is also provided with a rigid axle 12 press-fitted or molded thereto as will be described in detail with reference to FIGS. 2*a* and 2*b*. The axle 12, being an extrusion molded or press-fitted in the base plate 3, forms an integral part of the terminal housing of the pump.

The second structural group comprises two permanent magnets 14*a* and 14*b* for the electric motor arranged into a tubular partial housing 15 which also serves as a magnetic grounding tube.

The structural unit arranged to rotate on the rigid axle 12 can be considered the third structural group. This group includes a motor armature 7, the pump rotor 4 extrusion molded directly thereon thus forming a common one-piece part and further having a common bearing on axle 12 for the transmission of rotary motion.

Finally, as the fourth structural group, there is a flange-like terminal housing 10 on the pressure side of the pump provided with pressure nozzle 11 and with a central bore 16 which fixes the axle 12 on the side opposite the base plate 3 and means for fixedly locating the commutator brushes, brush springs, etc.

Figure 3A:
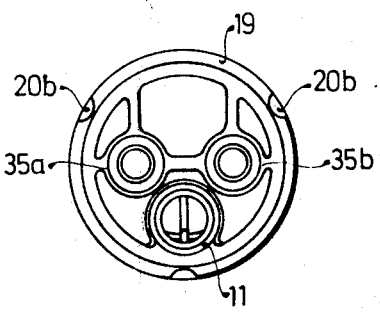
FIGS. 3*a* and 3*b* are the front and rear views of the flange-like terminal housing on the pressure side of the pump.

The molded or extruded parts which form the flange-like terminal housing parts 3 and 10, and adapted to be located at the ends of the central housing part 15, have radially extended ring flanges 18 and 19, so that when the central housing part 15 is slipped over the terminal housing parts 3 and 10, these ring flanges serve as a stop and the housing is then secured and fixed into this position by means of radially inwardly extending flanges formed on the housing part 15. To effect this, the ring flanges 18 and 19 on both parts of the pump have recesses 20*a* and 20*b* (see FIGS. 2*a* and 3*a*) distributed over their circumferences into which the radially inwardly extending parts of the housing part can be pressed. This central housing part, of course, also serves as a magnetic grounding tube.

Thus assembled, the fluid pump is ready for installation in a suitable tank. On the other hand, if the pump is to be employed outside a fuel tank, then O-ring seals with an outer housing must be employed surrounding all the above-mentioned structural parts which will be described in more detail.

A more detailed explanation of the individual main structural groups will now be described as to structure and mode of operation so that the simplicity of the structure and its cost effectiveness as a fuel supply pump will become more clear.

Figure 2B:
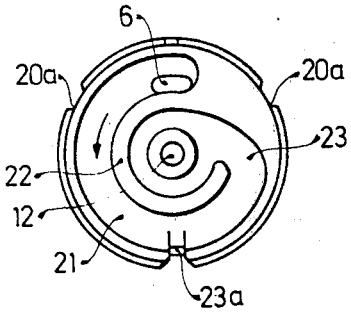

The first housing terminal or base plate 3 of the pump, being made of extrusion molded synthetic material, is preferably fiber glass reinforced and made fuel-resistant and is provided with the suction nozzle 5, which may be circular or kidney-shaped in cross section, and which communicates with the lateral channel 21. The kidney-shaped opening 6 is located at the initial area of the lateral channel as shown in FIG. 2*b*. This lateral channel 21 is approximately semicircular with the end area at 23 and opens into a pressure channel 22 centrally of the base plate. Again, the axle 12 is molded or press-fitted to the center of the base plate and the pump rotor 4 and armature 7 are mounted on the axle.

The pump rotor 4, in the embodiment shown, is an enclosed impeller having chambers semicircular in cross section distributed equally over the circumference on the side facing the lateral channel 21 and the energy exchange required for the supply fuel takes place in these chambers. A similar arrangement on the side of the base plate is not required since the smoothness of the molded plastic makes the frontal deviation and the upper surface areas sufficient.

The lateral channel 21 contains a groove 23*a* located near the last third of the channel, i.e., before the fluid therein reaches the pressure channel 22. This groove 23*a* is located on the outer periphery of the lateral channel and communicates with a slit 24 (See FIG. 1*a*) located on the outer diameter of the base plate in an axial direction. The groove 23*a* and slit 24 serve to divert any volume of gas which may form in the lateral channel 21 so that there is an effective ventilation of the pump. The groove 23*a* or the slit 24 may have a suitable throttle formed by a change in the cross-sectional area thereof so that there will be no loss of pressure. The ventilation of the pump by the axial slit 24 is possible in an in-tank installation but, in the case of an installation requiring an additional housing surrounding the pump, an additional nozzle or terminal (not shown) may be provided for a ventilation line.

In operation, the fluid flows through the suction nozzle 5 and entry opening 6 into the lateral channel 21 and there is transported under increasing pressure, in the direction of the arrow, to the interior pressure channel 22, as shown in FIG. 2*b*, resulting from the circular flow produced by the rotating propeller 4. The fuel then flows out of the pressure channel 22 through suitable axial exit openings 25 (FIG. 1*a*) spaced about the impeller 4. These openings communicate in an axial direction into the interior of the housing part and the fuel finally flows via the pressure nozzle 11 of the terminal housing 10 into the system which is to be supplied with fuel under pressure.

The motor armature 7 is formed of a laminar packet 26 and a core winding packet 27, around which a suitable synthetic material 28 is sprayed, which at the same time is part of the impeller 4 of the lateral channel pump 1. A sliding bearing 30 is pressed into this rotor unit on the pumping side in order to fix this structural unit on the pumping side on the rigid axle 12; the sliding bearing can be a bushing, for instance a DU bushing, made of a suitable substance.

Figure 1B:
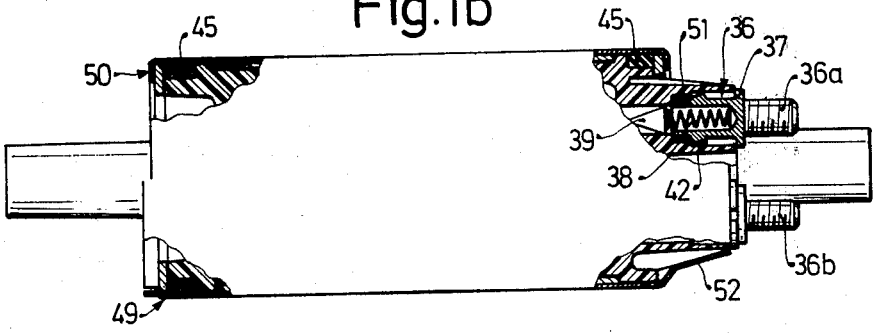
FIG. 1*b* is a top view of the pump shown in FIG. 1*a* partly cut away to show particularly the possible enclosure forms for use of the pump outside tank installations.
Figure 3B:
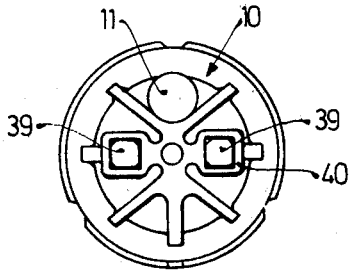

On the collector side, the bearing of the rotor unit on the axle 12 is formed by the synthetic mounting material of the laminar core. This rotor unit, comprising the pump rotor 4 and the motor armature 7, with a common bearing on the axle 12, at the same time fixedly locates the collector on the side oriented toward the pump. The collector, in the illustrated example, however, is not embodied as a bushing which axially extends the motor armature, but rather is in the form of a radial disc, so that the axially extending commutator bushings, displaced from the center of the terminal housing 10, under pressure, can glide on the collector disc. For this purpose, the terminal housing 10, which is shown in front and rear views in FIGS. 3*a* and 3*b*, has reception bores 35*a*, 35*b* next to the pressure nozzle 11, into which threaded terminal nozzles 36 are pressed, one of which is more clearly shown in FIG. 1*b*. These terminal nozzles 36, manufactured from a suitable, sleeve-like synthetic material, have outer screw threads 36*a*, 36*b*, with differing thread diameters for conducting the positive and negative supply voltages. These terminal nozzles 36 are electrically connected with brush springs 38 inside a bushing 37, which in turn are electrically interposed therebetween. The sealing O-rings 45 can be inserted on the outer diameter of the upper base plate 3 and terminal housing 10 of the pump into reception grooves already provided in the synthetic parts. The connection of the tubular outer housing with the terminal housing at either end of the pump can be effected in a number of ways as by means of a conical flanging of the housing, which can be an aluminum tube, as shown at 47 in FIG. 1*a*, or by forming the outer terminal housing initially as a deep-drawn aluminum cup, as shown at 48, into which the structural elements described above can be inserted. Finally, the connection of the outer housing 46 can also be effected, as shown at 49 in FIG. 1*b*, by an inward flanging of the preferably tubular aluminum housing, or by flanging the aluminum tube at a right angle, as is shown at 50 in FIG. 1*b*. Further O-rings 51 are inserted into a corresponding recess between the reception bore of the terminal housing 10 and the inserted bushing 37 to effect the sealing of the threaded terminal nozzles 36.

The sealing of the pump can also be effected with the aid of the fuel resistant contraction hose 52 surrounding all the structural elements of the fluid pump. This hose, as is well known, consists of a synthetic material with shape memory, with the ability to contract from an original size under appropriate heating to the significantly smaller dimensions. The contraction hose, which preferably has an interior layer which is more strongly fused, then firmly surrounds the individual pumping parts, securing and sealing them absolutely and through its hardening, further forms rim areas which firmly contact the base plate 3 and the terminal housing 10.

The axial play between the base plate 3 and pump impeller 4 at the motor armature may be infinitely adjusted either by means of the extension of the journal bearing 30 or by means of the inclusion of a spacer disc at this point. The compression force of the commutator brush springs 38 then acts to restrict the axial play. When wear takes place, then the axial play can only be further reduced thus increasing the effectiveness of the pump.

The foregoing relates to a preferred embodiment of the invention, it being understood that other embodiments and variants thereof are possible within the spirit and scope of the invention, the latter being defined by the appended claims.

What is claimed and desired to be secured by Letters Patent of the United States is:

1. A fluid pump, especially adaptable for supplying fuel to an automotive vehicle, including a pump system and an electric motor connected thereto in driving relationship and arranged in a common housing, said pump system, electric motor and common housing consisting of partially preassembled structural units, comprising:

a first structural unit comprising an outer terminal housing part having an axle made integral therewith;

a second structural rotor unit comprising a pump impeller and a motor armature mounted for rotation on said axle;

a third structural unit comprising a central partial housing surrounding said impeller and motor armature and adjoining the first terminal housing and including permanent magnets for said electric motor; and a fourth unit comprising a second terminal housing part forming a closure for said partial housing, a first terminal housing forming a second closure for said partial housing, said first terminal housing part and said second terminal housing part being made of synthetic material by extrusion molding with outwardly projecting nozzles thereon, one being a suction nozzle and the other being a pressure nozzle, both said terminal housing parts having radially extending flanges forming stop means for the central partial housing and, said central partial housing further including inwardly extending flanging means for engaging said terminal housings, said first terminal housing part and second terminal housing part having radial inwardly extending recesses and said central partial housing being provided with inwardly extending flanges for engaging said recesses, said first terminal housing part being provided with a lateral channel in the form of a partial ring, an interior pressure channel, a suction opening connected with said suction nozzle for the flow of fluid from said suction nozzle into said lateral channel and into said pressure channel and ventilation means for venting gases in said fluid out of said lateral channel, said ventilation means comprising radially extending groove means opening into said lateral channel and a peripherally located axial slit communicating with said groove for venting gases from said lateral channel.

2. The pump as claimed in claim 1 wherein said ventilation means further includes a throttling means responsive to changes of cross-sectional area of said slit and said groove for controlling the amount of gases flowing through said ventilation means.

3. The pump as claimed in claim 2, wherein said first terminal housing part is molded onto the axle.

4. The pump as claimed in claim 2, wherein said first terminal housing part is press-fitted onto said axle.

5. The pump as claimed in claim 3, wherein said motor armature is covered with a synthetic molded material which also forms said impeller which cooperates with said lateral channel and interior pressure channel to form a lateral channel pump and further including bearing means on the side of said motor armature adjacent said first terminal housing part.

6. The pump as claimed in claim 5, wherein a disc-like radial extension of the motor armature forms a collector for said motor armature and including commutator brushes axially fixed in the second terminal housing part.

7. The pump as claimed in claim 6, wherein said commutator brushes are disposed in guides pressed into said second terminal housing part and wherein said commutator brushes are forced into engagement with said collector by means of brush springs.

8. The pump as claimed in claim 7, wherein said second terminal housing part is provided with reception bores which communicate with said commutator guides and further including sleevelike threaded terminal nozzles which fixedly locate the brush springs and support a metal bearing part to effect the connection with conductors for the supply voltage.

9. The pump as claimed in claim 8, wherein said pump further includes a tubular outer housing which sealingly engages the first and second terminal housing parts, sealing means interposed between said outer housing and said pump against leakage, and means for fixing said outer housing to said terminal housing parts.

10. The pump as claimed in claim 9, wherein said outer housing comprises a contraction hose which is formed by heat to surround all structural elements of the pump and seal the pump against leakage.

11. The pump as claimed in claim 8, wherein any axial play between said first terminal housing part and said pump impeller is adjustable by said bearing means and where the axial play is restricted in movement by the commutator bushing springs.

12. The pump as claimed in claim 11, wherein there is included a bearing formed of said synthetic molded material on the side of said motor armature adjacent to said second terminal housing part.

* * * * *